US008204394B2

(12) United States Patent
Nakayama

(10) Patent No.: US 8,204,394 B2
(45) Date of Patent: Jun. 19, 2012

(54) IMAGE FORMING APPARATUS

(75) Inventor: Yasunori Nakayama, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 176 days.

(21) Appl. No.: 12/812,737

(22) PCT Filed: Sep. 9, 2009

(86) PCT No.: PCT/JP2009/065706

§ 371 (c)(1),
(2), (4) Date: Jul. 13, 2010

(87) PCT Pub. No.: WO2010/032660

PCT Pub. Date: Mar. 25, 2010

(65) Prior Publication Data

US 2010/0284704 A1 Nov. 11, 2010

(30) Foreign Application Priority Data

Sep. 18, 2008 (JP) ..... 2008-239534

(51) Int. Cl.
*G03G 15/00* (2006.01)
*G03G 15/01* (2006.01)
*G03G 15/16* (2006.01)

(52) U.S. Cl. ..... 399/49; 399/66; 399/71; 399/302

(58) Field of Classification Search ..... 399/49, 399/66, 71, 101, 302
See application file for complete search history.

(56) References Cited

U.S. PATENT DOCUMENTS

2006/0067729 A1 3/2006 Ikeda et al.
2008/0226313 A1 9/2008 Tsuchida et al.

FOREIGN PATENT DOCUMENTS

| | | |
|---|---|---|
| CN | 1755547 | 4/2006 |
| EP | 1643318 | 4/2006 |
| JP | A-2006-30737 | 2/2006 |
| JP | A-2006-098777 | 4/2006 |
| JP | A-2006-163267 | 6/2006 |
| JP | A-2007-240673 | 9/2007 |
| JP | A-2008-076472 | 4/2008 |
| JP | A-2008-224955 | 9/2008 |
| KR | 10-2006-0051707 | 5/2006 |
| KR | 10-2007-0099499 | 10/2007 |

OTHER PUBLICATIONS

International Search Report mailed Oct. 20, 2009 directed to PCT/JP2009/065706; 4 pages.

*Primary Examiner* — Sophia S Chen
(74) *Attorney, Agent, or Firm* — Morrison & Foerster LLP

(57) ABSTRACT

In an image forming apparatus, image adjustment is performed by detecting a toner image constituting an image adjustment pattern 22 transferred to an intermediate transfer member. On the intermediate transfer member 2, a leading pattern 21 longer than a circumference of a secondary transfer roller 13 is formed at a leading position in a travelling direction of the intermediate-transfer-member ahead of the image adjustment pattern 22 by using a toner that is highest in brightness among toners used for the image adjustment pattern 22 or a toner that is higher in brightness than any toner used for the image adjustment pattern 22. Staining of the rear face of the recording medium due to toner adhering to the secondary transfer roller is prevented without increasing the apparatus scale.

7 Claims, 5 Drawing Sheets

*Fig. 7*
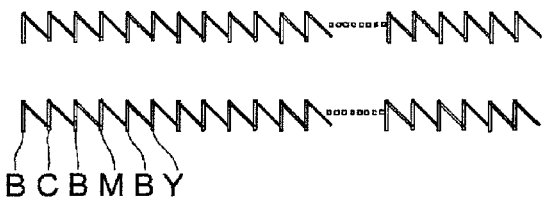
*Fig. 8 (a)* INVENTION
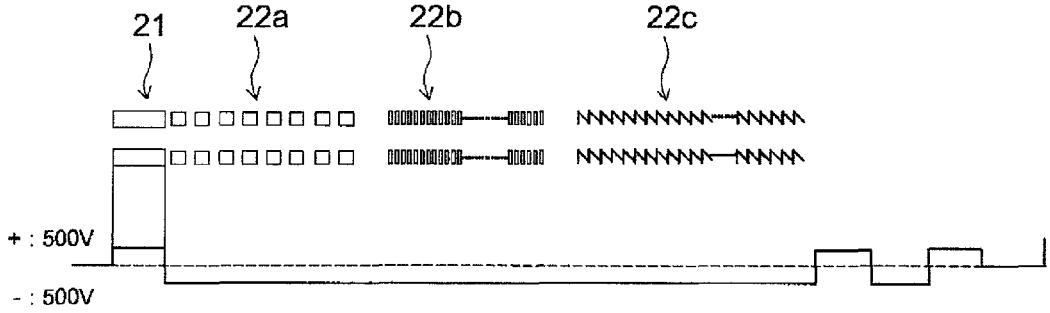
*Fig. 8 (b)* PRIOR ART EXAMPLE
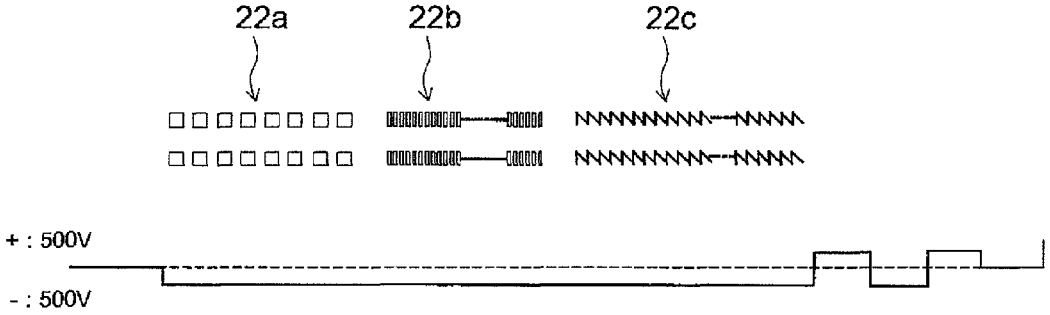

| | NUMBER OF CLEANING TIMES | | | | | | | | | |
|---|---|---|---|---|---|---|---|---|---|---|
| | 1 | 2 | 3 | 4 | 5 | 6 | 7 | 8 | 9 | 10 |
| PRIOR ART EXAMPLE | × | × | × | × | × | × | × | × | △ | ○ |
| INVENTION EXAMPLE | × | × | × | × | ○ | ○ | — | — | — | — |

○ : NO STAINS OCCURRED
△ : SLIGHT STAINS OCCURRED
× : STAINS OCCURRED

IMAGE FORMING APPARATUS

CROSS-REFERENCE TO RELATED APPLICATIONS

This application is a national stage application under 35 USC 371 of International Application No. PCT/JP2009/065706, filed Sep. 9, 2009, which claims the priority of Japanese Application No. 208-239534, filed Sep. 18, 2008, the contents of which prior applications are incorporated herein by reference.

FIELD OF THE INVENTION

The present invention relates to a monochrome or color electrophotographic type of image forming apparatuses such as copying machines, printers, facsimiles, and multi-functional machines having these functions.

BACKGROUND OF THE INVENTION

Conventionally, in an image forming apparatus by an electrophotographic method, the surface of a photoconductor drum is charged and exposed to form an electrostatic latent image, the electrostatic latent image is developed with toner to form a toner image, the toner image is primarily transferred onto an intermediate transfer belt to form a composite toner image, the composite toner image is then secondarily transferred onto a recording medium, and then the composite toner image on the recording medium is fixed. In such an image forming apparatus, an image adjustment pattern such as adhesion amount control pattern, color matching pattern and gray level correction pattern is formed on the intermediate transfer belt as a toner image, and the image adjustment pattern is detected to perform an image adjustment.

As the image adjustment pattern on the intermediate transfer belt passes through a secondary transfer roller, toner adheres to the secondary transfer roller, so that the toner then adheres to the rear face of a paper sheet on which next image formation is to be performed, with a result of sheet stains. Accordingly, during the image adjustment, generally, the secondary transfer roller is released away from the intermediate transfer belt so as to prevent the toner from adhering to the secondary transfer roller. However, with this constitution, when the secondary transfer roller is brought into contact with the intermediate transfer belt after image adjustment, the intermediate transfer belt vibrates and changes in speed, with the result that color misregistration occurs during image formation irrespectively of the image adjustment having been executed. Due to this, image formation is started after the secondary transfer roller comes into complete contact with the intermediate transfer belt. However, this causes a large time lag from when a print button is pushed until when image formation is started, resulting in deterioration of printing productivity as a problem. Moreover, because of a difference between a speed of the intermediate transfer belt at the time of image adjustment when the secondary transfer roller is separated from the intermediate transfer belt and a speed of the intermediate transfer belt at the time of image formation when the secondary transfer roller is in contact with the intermediate transfer belt, even if the image adjustment pattern is detected with high precision, there occurs a change in image formation position at the time of actual image formation, which causes a problem that misregistration of color may occur.

As a solution, there has been proposed an image forming apparatus in which a secondary transfer roller is constantly in contact with an intermediate transfer belt. In this image forming apparatus, staining of the secondary transfer roller are prevented, for example, by providing a cleaning member for cleaning toner adhering onto the secondary transfer roller during the formation of the image adjustment pattern or by applying a bias voltage of same polarity as the toner to the secondary transfer roller.

However, with the cleaning member provided on the secondary transfer roller, not only such a cleaning member as a blade but also a container for supporting the cleaning member and containing toner removed by the cleaning member as well as a mechanism for discharging toner are necessitated, leading to a complicated, larger-scale apparatus. Besides, there is a need for enhancing the releasability for toner of the secondary transfer roller, posing a problem of a cost increase involved.

With the constitution that a bias voltage of same polarity as toner is applied to the secondary transfer roller, since the adhesion amount control pattern or the color matching pattern involves formation of a toner image extending over a relatively long distance on the intermediate transfer belt, it could occur that toner adheres to the secondary transfer roller even with suppression of the toner adhesion by the bias voltage. Thus, there is a need for cleaning the secondary transfer roller with a cleaning member before image formation, posing a problem of deteriorated print productivity.

Patent Document 1 proposes that a transparent toner layer is formed at a ground layer or top layer of the colored toner image in the primary transfer so as to prevent staining of the rear face of the recording medium. However, this proposal involves a transparent toner cartridge in addition to a colored toner cartridge, posing a problem of an increase in the apparatus scale.

SUMMARY OF INVENTION

The present invention having been achieved in view of the above-described problems of the prior art, an object of the invention is to provide an image forming apparatus capable of preventing staining of the rear face of the recording medium due to toner adhering to the secondary transfer roller without involving any increase in the apparatus scale.

In order to achieve the above object, as a first solution, there is provided an image forming apparatus comprising:

an image forming unit developing an electrostatic latent image formed on an image carrier to form a specified toner image;

a primary transfer unit transferring the toner image formed by the image forming unit to an intermediate transfer member; and a secondary transfer roller secondarily transferring the toner image transferred to the intermediate transfer member to a recording medium, whereby image adjustment is performed by detecting a toner image constituting an image adjustment pattern, which is formed by the image forming unit and transferred to the intermediate transfer member, wherein on the intermediate transfer member, a leading pattern longer than a circumference of the secondary transfer roller is formed at a leading position in a travelling direction of the intermediate transfer member ahead of the image adjustment pattern by using a toner that is highest in brightness among toners used for the image adjustment pattern or a toner that is higher in brightness than any toner used for the image adjustment pattern.

As a second solution, in the first solution, the toner of the leading pattern has a brightness of 80 or higher.

As a third solution, in each of the foregoing solutions, the toner of the leading pattern is yellow toner.

As a fourth solution, in each of the foregoing solutions, the leading pattern has a width larger than a width of the image adjustment pattern.

As a fifth solution, in each of the foregoing solutions, the image forming apparatus further comprises a bias voltage applying unit applying a bias voltage of reverse polarity with respect to the toner to the secondary transfer roller in secondary transfer to the recording medium, wherein while the leading pattern is passing through the secondary transfer roller, a bias voltage of reverse polarity with respect to the toner is applied to the secondary transfer roller by the bias voltage applying unit.

As a sixth solution, in the fifth solution, while the image adjustment pattern is passing through the secondary transfer roller, a bias voltage of same polarity as the toner is applied to the secondary transfer roller by the bias voltage applying unit.

As a seventh solution, in the fifth or sixth solution, after the leading pattern and the image adjustment pattern have passed through the secondary transfer roller, a bias voltage of same polarity as the toner and a bias voltage of reverse polarity with respect to the toner are alternately applied to the secondary transfer roller by the bias voltage applying unit.

According to the invention of the first solution, since the leading pattern is formed on the leading side of the image adjustment pattern by using a toner of high brightness, a toner of high brightness first adheres to the secondary transfer roller and thereafter the image adjustment pattern adheres thereto. Since the image adjustment pattern is removed by a bias voltage applying unit of the secondary transfer roller ahead of the toner of the leading pattern, it is the toner of high brightness that may remain, and the toner is inconspicuous for naked eyes and not recognized as stains.

According to the invention of the second solution, even if the toner having a brightness of 80 or higher adheres to the rear face of the recording medium, the toner is inconspicuous for naked eyes and not recognized as stains.

According to the invention of the third solution, even if the yellow toner adheres to the rear face of the recording medium, the toner is more inconspicuous for naked eyes as compared with the colors of magenta, cyan and black, and not recognized as stains.

According to the invention of the fourth solution, even if the image adjustment pattern is shifted out of registration, toner of lower brightness of the image adjustment pattern adheres onto the toner of high brightness of the leading pattern on the secondary transfer roller, so that the toner of low brightness neither remains on the secondary transfer roller nor stains the rear face of the paper sheet.

According to the invention of the fifth solution, while the leading pattern is passing through the secondary transfer roller, the toner of high brightness of the leading pattern is moved in more amounts from the intermediate transfer belt to the secondary transfer roller, so that the toner of low brightness of the following image adjustment pattern securely adheres onto the toner of high brightness on the secondary transfer roller. Thus, the toner of low brightness neither remains on the secondary transfer roller nor stains the rear face of the paper sheet.

According to the invention of the sixth solution, the toner of low brightness of the image adjustment pattern is inhibited from adhering onto the toner of high brightness of the leading pattern that has moved onto the secondary transfer roller. Thus, the toner of low brightness neither remains on the secondary transfer roller nor stains the rear face of the paper sheet.

According to the invention of the seventh solution, since a bias voltage of same polarity as the toner and a bias voltage of reverse polarity are alternately applied to the secondary transfer roller, the toner that has adhered to the secondary transfer roller can be moved to the intermediate transfer belt by shaking action, thus making it possible to efficiently clean the secondary transfer roller.

BRIEF DESCRIPTION OF DRAWINGS

FIG. 7 is an enlarged view of a main-scanning direction position detection pattern;

FIG. 8 is a diagram showing patterns and a bias voltage waveform of the invention and a prior art example used in an experiment for verifying effects of the invention;

EXPLANATION OF THE NUMERALS

Figure 1:
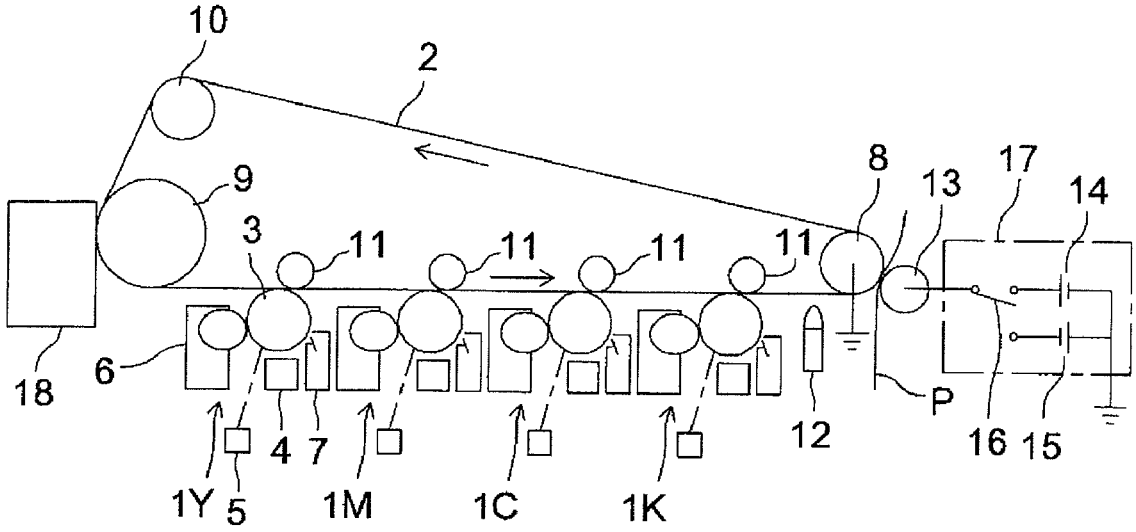
FIG. 1 is a schematic structural view of an image forming section of an image forming apparatus according to an embodiment of the present invention.
Figure 2A:
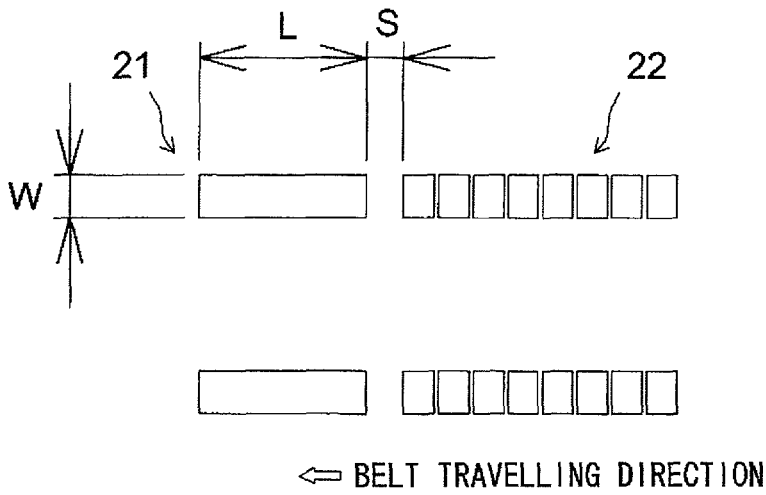
FIG. 2 is side views of a secondary transfer roller part showing process from when a leading pattern and an image adjustment pattern are formed on the intermediate transfer belt until when the image is transferred to a paper sheet according to the embodiment of the invention.
Figure 2B:
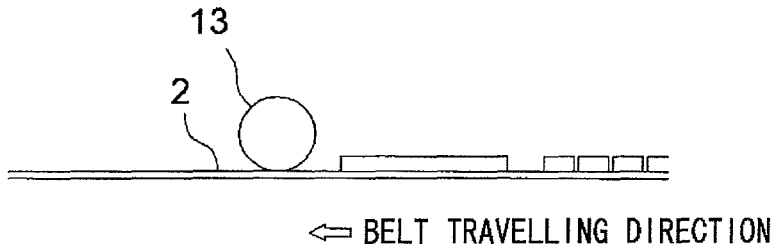
Figure 2C:
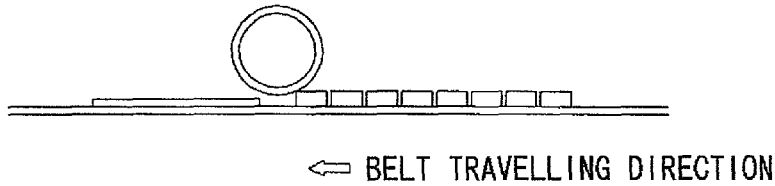
Figure 2D:
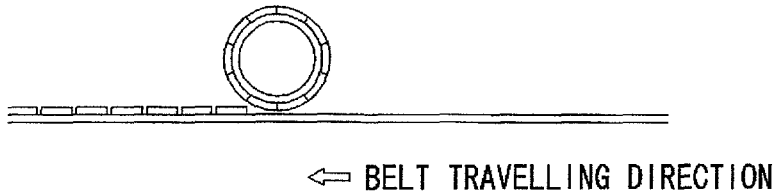
Figure 2E:
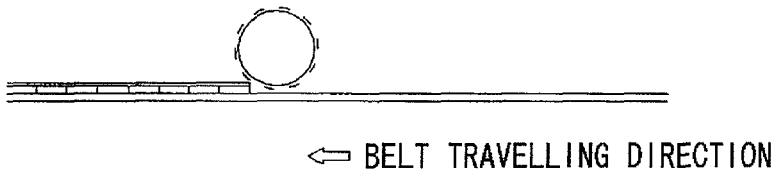
Figure 2F:
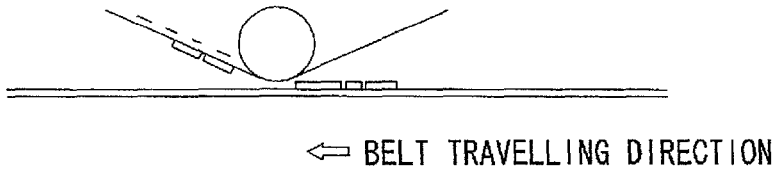

1Y, 1M, 1C, 1K Image forming unit
2 Intermediate transfer belt (intermediate transfer member)
3 Image carrier
6 Developing unit
11 Primary transfer roller
13 Secondary transfer roller
17 Bias voltage applying unit
21 Leading pattern
22 Image adjustment pattern

DETAILED DESCRIPTION OF THE INVENTION

Hereinbelow, embodiments of the present invention will be described with reference to the accompanying drawings.

FIG. 1 is a schematic structural view of an image forming section of an image forming apparatus for embodying the invention. The image forming section has image forming units 1Y, 1M, 1C, 1K for forming toner images of their corresponding colors of Y (Yellow), M (Magenta), C (Cyan) and K (Black), respectively, arranged along a linear portion of the intermediate transfer belt 2.

Each of the image forming units 1Y, 1M, 1C, 1K is made up of: an image carrier 3 formed of a photoconductor drum placed in proximity to the intermediate transfer belt 2; a charger unit 4 for uniformly charging a surface of the image carrier 3 to form a potential; an exposure unit 5 for making the surface of the image carrier 3 exposed to light based on an image signal to form an electrostatic latent image; a developing unit 6 for making toner adhering to the electrostatic latent image on the image carrier 3 to actualize it so that a toner image of respective color is formed; and a cleaning unit 7 for removing toner remaining on the image carrier 3.

The intermediate transfer belt 2 is stretched over a driving roller 8, a driven roller 9 and an intermediate roller 10 and enabled to run in an arrow direction. Inside the intermediate transfer belt 2, primary transfer rollers 11 are provided so as to face the image carriers 3 of the image forming units 1Y, 1M, 1C, 1K, respectively, via the intermediate transfer belt 2. The primary transfer rollers 11 transfer the toner images on the image carriers 3 onto the intermediate transfer belt 2 to form color toner images. Between the black image forming unit 1K and the driving roller 8 of the intermediate transfer belt 2 is located an image density sensor 12 for detecting an image adjustment pattern formed on the intermediate transfer belt 2.

A secondary transfer roller 13 for transferring the color toner image formed on the intermediate transfer belt 2 to a paper sheet P fed from an unshown sheet feed section is provided so as to face the driving roller 8 of the intermediate transfer belt 2 via the intermediate transfer belt 2. The secondary transfer roller 13 is provided with a bias voltage applying unit 17 which is composed of a first DC power source 14, a second DC power source 15 and a selector switch 16 for switching between a positive terminal of the first DC power source 14 and a negative terminal of the second DC power source 15 so that the bias voltage applying unit 17 can apply a voltage of same polarity as the toner charging polarity and a voltage of reverse polarity alternately to the secondary transfer roller 13. It is noted that the secondary transfer roller 13 is provided with no mechanism for bringing the secondary transfer roller 13 into and out of contact with the intermediate transfer belt 2.

A belt cleaning unit 18 for removing toner remaining on the intermediate transfer belt 2 is provided so as to face the driven roller 9 of the intermediate transfer belt 2 via the intermediate transfer belt 2.

Image forming operation itself of the image forming apparatus constructed as described above is well known and its description is omitted. Operation for forming an image forming pattern in image adjustment will be described below.

For the image adjustment, a yellow leading pattern 21 is first formed by the image forming units 1Y, 1M, 1C, 1K on the intermediate transfer belt 2 as shown in FIG. 2(*a*) and (*b*), and then a specified image adjustment pattern 22 is formed thereon. It is noted that steps following FIG. 2(*b*) are shown with the intermediate transfer belt 2 linearly developed for simplicity's sake.

A length L of the leading pattern 21 is set longer than a circumference of the secondary transfer roller 13. If the length L of the leading pattern 21 is shorter than the circumference of the secondary transfer roller 13, toner of the leading pattern 21 adhering to the secondary transfer roller 13 ends in an outer peripheral surface of the secondary transfer roller 13 and the image adjustment pattern 22 lower in brightness than yellow adheres to the toner-ended surface, thus making it impossible to suppress stains. A width W of the leading pattern 21 is set larger than a width of the image adjustment pattern 22. If the width W of the leading pattern 21 is smaller than the width of the image adjustment pattern 22, toner of the image adjustment pattern 22, which is lower in brightness than yellow, adheres to the secondary transfer roller 13 outside the width W of the leading pattern 21 when the image adjustment pattern 22 has shifted, thus making it impossible to suppress stains. A spacing between the leading pattern 21 and the image adjustment pattern 22 is preferably set as short as possible. Before the leading pattern 21 that has once adhered to the secondary transfer roller 13 is removed, it is preferred that toner of the next image adjustment pattern 22 adheres thereto.

The image adjustment pattern 22 formed on the intermediate transfer belt 2 is detected by the image density sensor 12, and specified image adjustment is performed. Details of the image adjustment have no direct relation with the present invention and are well known, their description being omitted.

Among the leading pattern 21 and the image adjustment pattern 22 formed on the intermediate transfer belt 2, the leading pattern 21 first passes through the secondary transfer roller 13 as shown in FIG. 2(*c*). As a result, part of the yellow toner of the leading pattern 21 adheres to the overall circumference of the secondary transfer roller 13. In this case, it is more effective to apply, to the secondary transfer roller 13, a bias voltage of reverse polarity with respect to the toner by the bias voltage applying unit 17. Remaining toner is carried on as it remains on the intermediate transfer belt 2, and removed by the belt cleaning unit 18. Subsequently, as shown in FIG. 2(*d*), part of the toner of the image adjustment pattern 22 adheres onto the yellow toner of the secondary transfer roller 13. The rest of the toner, like the yellow toner of the leading pattern, is carried as it remains on the intermediate transfer belt 2, and then removed by the belt cleaning unit 18.

Figure 3:
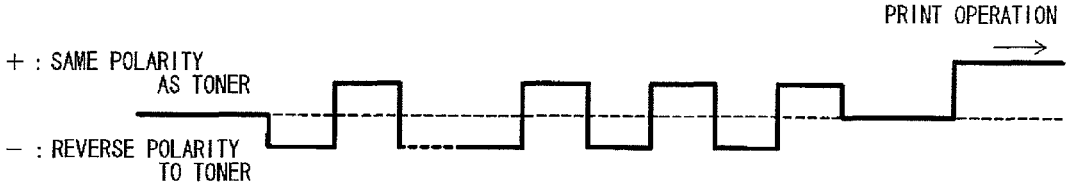
FIG. 3 is a waveform diagram of a bias voltage to be applied to the secondary transfer roller in the embodiment of the invention.

Next, by the bias voltage applying unit 17 of the secondary transfer roller 13, a bias voltage of same polarity with respect to the toner is applied to the secondary transfer roller 13 to clean the secondary transfer roller 13. In this operation, it is more effective to apply bias voltages of same polarity and reverse polarity with respect to the toner charging polarity such as shown in FIG. 3 to clean the secondary transfer roller 13. As a result of this, as shown in FIG. 2(*e*), the toner of the top-layered image adjustment pattern 22 adhering to the secondary transfer roller 13 is firstly electrostatically moved onto the intermediate transfer belt 2, and the yellow toner of the leading pattern 21 is subsequently electrostatically moved onto the intermediate transfer belt 2. These kinds of toner are carried on the intermediate transfer belt 2 and removed by the belt cleaning unit 18. The yellow toner of the lowest layer adhering to the secondary transfer roller 13 may remain on the surface of the secondary transfer roller 13 without being moved completely to the intermediate transfer belt 2. However, since the yellow toner is higher in brightness than other kinds of toner used for the image adjustment pattern 22 or toner used for image formation, stains are inconspicuous even if the yellow toner has adhered to the rear face of the sheet P during the image formation as shown in FIG. 2(*f*).

Figure 4:
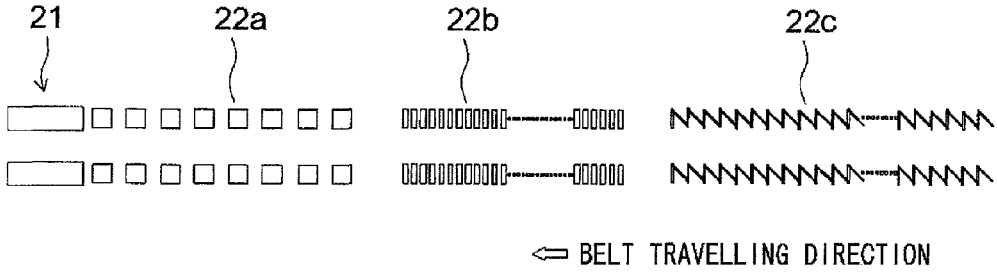
FIG. 4 is a diagram showing a leading pattern and an image adjustment pattern to be formed on the intermediate transfer belt in the embodiment of the invention.

FIG. 4 shows an example of the leading pattern 21 and the image adjustment pattern 22 formed on the intermediate transfer belt 2.

The leading pattern 21 is a continuous pattern of two lines using yellow toner. The leading pattern 21, having a width of 20 mm, is formed 5 mm wider than the later-described image adjustment pattern 22. The leading pattern 21 has a length of 65 mm, longer than a circumference ($20\pi$=62.8 mm) of the secondary transfer roller 13 having an outer diameter of 20 mm.

The image adjustment pattern 22 is composed of a toner adhesion amount detection pattern 22*a*, a sub-scanning direction position detection pattern 22*b*, and a main-scanning direction position detection pattern 22*c*. The three detection patterns are the longest combination formed by actual equipment.

Figure 5:
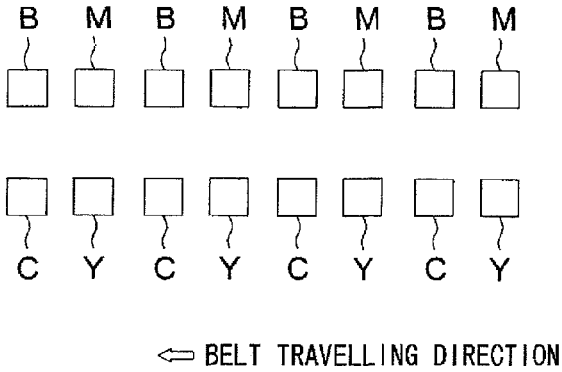
FIG. 5 is an enlarged view of a toner adhesion amount detection pattern.

The toner adhesion amount detection pattern 22*a*, which is a pattern for detecting a toner adhesion amount, is formed on the intermediate transfer belt 2 with the toner adhesion amount changed as shown in FIG. 5. A position where the toner adhesion amount detection pattern 22*a* is formed is provided in two lines along the image travelling direction in accordance with the position of the image density sensor 12. As the toner adhesion amount detection pattern 22*a* of each line, a plurality of 15×15 mm square patterns of different colors are formed successively with the density changed. The square patterns are spaced with an interval of 7 mm and their overall length is 85 mm. Cyan and yellow square patterns are alternately formed for one line while magenta and black square patterns are alternately formed for the other line.

Figure 6:
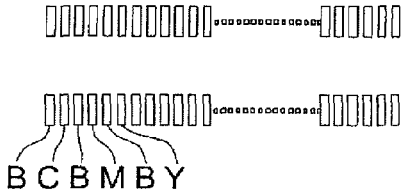
FIG. 6 is a sub-scanning direction position detection pattern.

The sub-scanning direction position detection pattern 22*b* is formed with an interval of 50 mm to the toner adhesion amount detection pattern 22*a*. The sub-scanning direction position detection pattern 22*b*, which is a pattern for detecting a print position for a reference color in the image travelling direction, is given by forming narrow, long patterns extending in the main scanning direction in a ladder-like form at regular intervals on the same lines as the toner adhesion amount detection pattern 22*a* is provided as shown in FIG. 6, where the overall length of the sub-scanning-direction position detection pattern 22*b* is 286 mm.

The main-scanning direction position detection pattern 22*c* is formed with an interval of 50 mm to the sub-scanning direction position detection pattern 22*b*. The main-scanning direction position detection pattern 22*c*, which is a pattern for detecting a print start position for a reference color in a direction orthogonal to the image travelling direction, is given by forming narrow, long patterns extending in the main scanning direction and slant patterns in succession on the same lines as the toner adhesion amount detection pattern 22*a* is provided as shown in FIG. 7, where the overall length of the main-scanning-direction position detection pattern 22*c* is 270 mm.

The inventor performed an experiment for verifying effects of the present invention.

First, on the intermediate transfer belt 2, a leading pattern 21 and image adjustment patterns 22*a*, 22*b*, 22*c* shown in FIG. 8(*a*) were formed as an invention example, and image adjustment patterns 22*a*, 22*b*, 22*c* shown in FIG. 8(*b*) were formed in succession as a prior art example.

While the leading pattern 21 was passing through the secondary transfer roller 13, a +500 V reverse-polarity voltage, which is reverse in polarity to toner, was applied to the secondary transfer roller 13 in the invention example. This was intended to move larger amounts of toner from the intermediate transfer belt 2 to the secondary transfer roller 13 so that the invention effects can be enhanced. In contrast to this, no bias voltage was applied in the prior art example.

While the image adjustment patterns 22*a*, 22*b*, 22*c* were passing through the secondary transfer roller 13, a voltage of same polarity as toner was applied to the secondary transfer roller 13 in both the invention example and the prior art example. This was intended to suppress adhesion of toner to the secondary transfer roller 13.

After all the patterns 21, 22*a*, 22*b*, 22*c* passed through the secondary transfer roller 13, a −500 V bias voltage of same polarity and a +500 V bias voltage of reverse polarity with respect to the toner were alternately applied to the secondary transfer roller 13 in both the invention example and the prior art example.

After these patterns 21, 22*a*, 22*b*, 22*c* passed through the secondary transfer roller 13, the sheet P was made to pass through the secondary transfer roller 13, where brightnesses on the near front side and on the far deep side of the sheet rear face were measured and moreover stains were visually evaluated.

A copier made by Konica Minolta, BizhubC353, was used as a copier for forming patterns. By using a spectral colorimeter CM-2600d made by Konica Minolta, brightness was measured under conditions of a D65 light source and an irradiation angle of 2°. As toner and paper sheets, the following ones having brightnesses measured under the above conditions were used:

Yellow: 90.24
Magenta: 47.91
Cyan: 53.53
Black: 23.12
Sheet (CF paper made by Konica Minolta):
94.3-94.4

The experiment described above was carried out while the number of times (cycle) of bias voltage application was changed from 1 to 10.

Figures 9, 10:
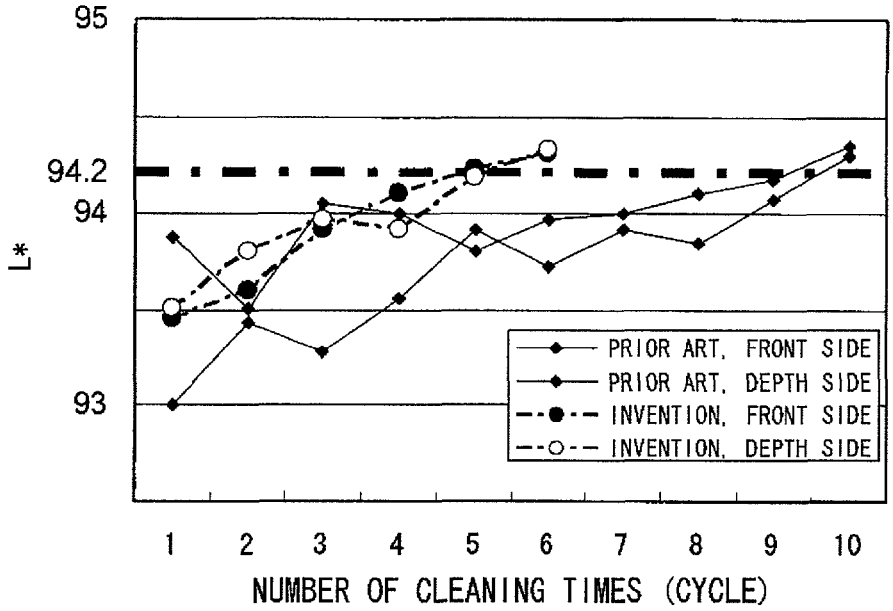
FIG. 9 is a chart showing a relationship between number of cleaning times and brightness of the sheet rear face obtained in the experiment for verifying effects of the invention.
FIG. 10 is a table showing evaluations of the invention example and a prior art example in the experiment for verifying effects of the invention.

FIGS. 9 and 10 show results of the experiment. In the prior art example, the brightness of the sheet rear face was 94.2 or more, necessitating 10 or more times of cleaning operations until stains were eliminated. In contrast to this, in the invention example, 5 times of cleaning operations resulted in a brightness of 94.2 or more, eliminating stains, hence one half of the number of times of cleaning operations in comparison to the prior art example.

The invention claimed is:

1. An image forming apparatus comprising:

an image forming unit developing an electrostatic latent image formed on an image carrier to form a specified toner image;

a primary transfer unit transferring the toner image formed by the image forming unit to an intermediate transfer member; and a secondary transfer roller secondarily transferring the toner image transferred to the intermediate transfer member to a recording medium, whereby image adjustment is performed by detecting a toner image constituting an image adjustment pattern, which is formed by the image forming unit and transferred to the intermediate transfer member, wherein on the intermediate transfer member, a leading pattern longer than a circumference of the secondary transfer roller is formed at a leading position in a travelling direction of the intermediate transfer member ahead of the image adjustment pattern by using a toner that is highest in brightness among toners used for the image adjustment pattern or a toner that is higher in brightness than any toner used for the image adjustment pattern.

2. The image forming apparatus as claimed in claim 1, wherein the toner of the leading pattern has a brightness of 80 or higher.

3. The image forming apparatus as claimed in claim 1, wherein the toner of the leading pattern is yellow toner.

4. The image forming apparatus as claimed in claim 1, wherein the leading pattern has a width larger than a width of the image adjustment pattern.

5. The image forming apparatus as claimed in claim 1, further comprising:

a bias voltage applying unit applying a bias voltage of reverse polarity with respect to the toner to the secondary transfer roller in secondary transfer to the recording medium, wherein while the leading pattern is passing through the secondary transfer roller, a bias voltage of reverse polarity with respect to the toner is applied to the secondary transfer roller by the bias voltage applying unit.

6. The image forming apparatus as claimed in claim 5, wherein while the image adjustment pattern is passing through the secondary transfer roller, a bias voltage of same polarity as the toner is applied to the secondary transfer roller by the bias voltage applying unit.

7. The image forming apparatus as claimed in claim 5, wherein after the leading pattern and the image adjustment pattern have passed through the secondary transfer roller, a bias voltage of same polarity as the toner and a bias voltage of reverse polarity with respect to the toner are alternately applied to the secondary transfer roller by the bias voltage applying unit.

* * * * *